United States Patent [19]

Knechtel

[11] Patent Number: 4,515,460

[45] Date of Patent: May 7, 1985

[54] DEVICE FOR TRANSFERRING COLOR TONER IMAGES

[75] Inventor: Wilhelm Knechtel, Biebertal, Fed. Rep. of Germany

[73] Assignee: Canon Kabushiki Kaisha, Tokyo, Japan

[21] Appl. No.: 487,136

[22] Filed: Apr. 21, 1983

[30] Foreign Application Priority Data

Apr. 21, 1982 [DE] Fed. Rep. of Germany ..... 3214677

[51] Int. Cl.[3] ..... G03G 15/01; G03G 15/16

[52] U.S. Cl. ..... 355/3 TR; 355/4; 355/14 TR

[58] Field of Search ..... 355/4, 3 TR, 14 TR, 355/3 BE; 430/42, 126; 118/645

[56] References Cited

U.S. PATENT DOCUMENTS 3,838,919 10/1974 Takahashi ..... 355/4

FOREIGN PATENT DOCUMENTS 164372 12/1981 Japan ..... 355/3 R

*Primary Examiner*—A. T. Grimley
*Assistant Examiner*—J. Pendegrass
*Attorney, Agent, or Firm*—Fitzpatrick, Cella, Harper & Scinto

[57] ABSTRACT

A device for transferring color toner images of a type, in which a plurality of color toner images are sequentially transferred onto an intermediate image transfer member, and the color toner images thus laid down on the intermediate member are finally transferred in one step onto an image transfer member. The intermediate transfer member is usually set apart from the latent image holding member, and brought into contact with it only at the time of image transfer so as to keep the toner images on the intermediate transfer member in loose layer form, whereby the toner images in a plurality of colors can be transferred onto the image transfer material with good efficiency.

4 Claims, 1 Drawing Figure

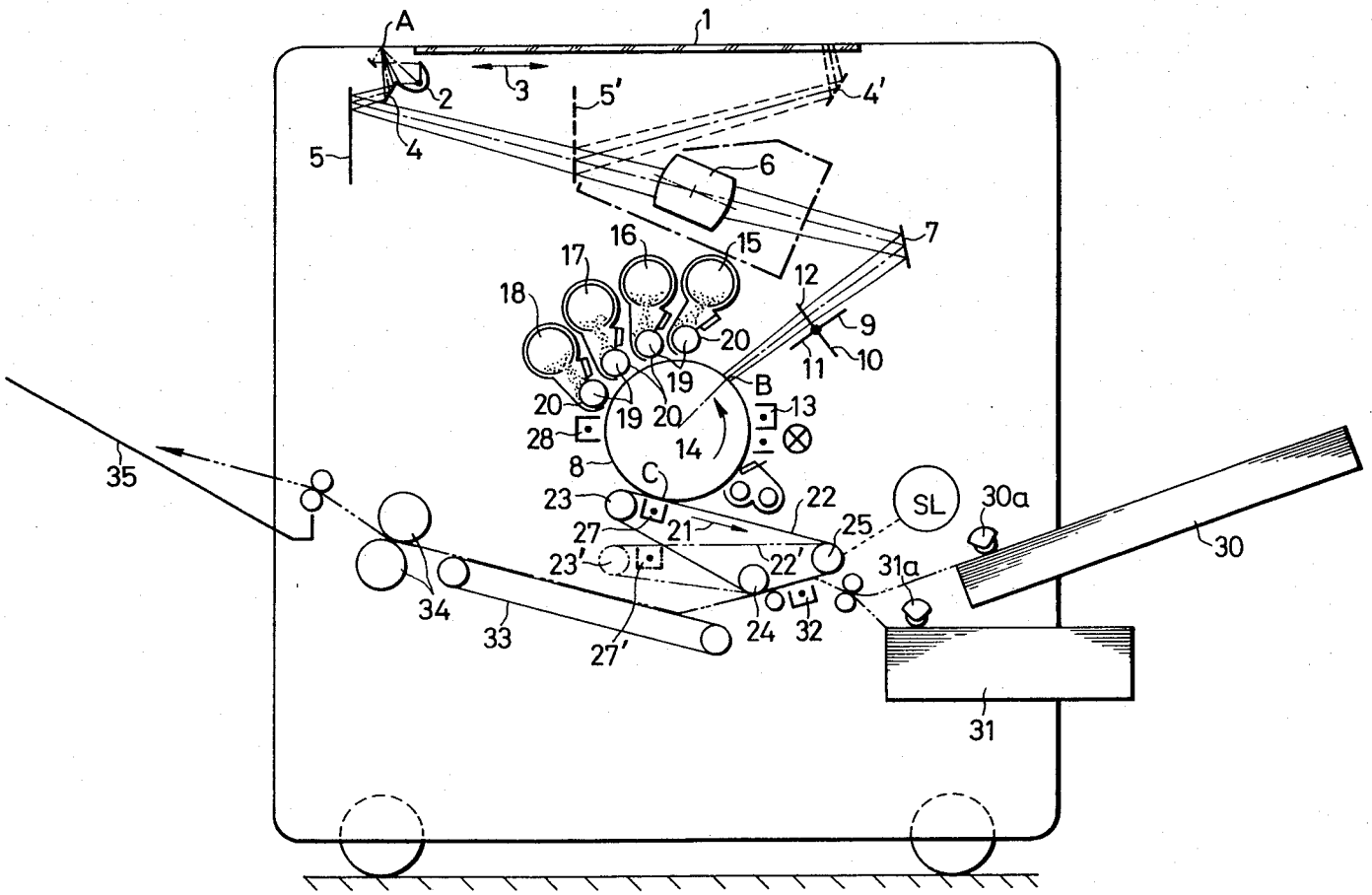
1
2
3
4
4'
5
5'
6
7
8
9
10
11
12
13
14
15
16
17
18
19
20
21
22
22'
23
23'
24
25
27
27'
28
30
30a
31
31a
32
33
34
35
A
B
C
SL

DEVICE FOR TRANSFERRING COLOR TONER IMAGES

BACKGROUND OF THE INVENTION

1. Field of the Invention

This invention relates to an image transfer device of a type, in which toner images formed on a latent image holding member such as a photosensitive member, an insulating member, etc. are sequentially transferred onto an intermediate image transfer member, and, finally, the images thus transferred onto the intermediate image transfer member are transferred onto a final image transfer material in a single step.

2. Description of the Prior Art

In a color reproduction apparatus in accordance with the prior art, a device for gathering toner images sequentially formed on a photosensitive member comprises an image transfer drum which is in constant, high pressure contact with the photosensitive member. On account of this, the toner images which are transferred onto the image transfer drum are compressed by the pressure-contact between the image transfer drum and the photosensitive member. Such compression of the toner images produces poor results when the combined toner images are transferred onto a copying sheet in a subsequent and final image transfer

SUMMARY OF THE INVENTION

It is therefore an object of the present invention to provide an image transfer device which enables those toner images formed in layers, i.e. superposed, by a plurality of image transfer operations to be transferred onto copying sheets in good condition.

According to a general aspect of the present invention, there is provided an image transfer device for color toner images which comprises a latent image holding member; means for forming latent images on this latent image holding member; developing means for developing the latent image; an intermediate image transfer member for receiving thereon toner images as developed by the developing means; and means for transferring the toner images on this intermediate image transfer member onto a final image transfer material, the latent image holding member and the intermediate image transfer member being brought into mutual contact only at the time of image transfer.

The foregoing object, other objects as well as a specific construction of the present invention will become more apparent and understandable from the following detailed description of the invention, when read in conjunction with the accompanying drawing.

BRIEF DESCRIPTION OF THE DRAWING

The single FIGURE of drawing illustrates a principal part, in cross-section, of a color reproduction apparatus, to which the present invention is applied.

DETAILED DESCRIPTION OF PREFERRED EMBODIMENT

The electrophotographic color reproduction apparatus according to one embodiment of the present invention is so constructed that an endless belt used as an intermediate image transfer member for transferring therefrom multi-transferred toner images onto a copying sheet is lightly urged against the surface of the photosensitive member only during transfer operations. As a result, the toner images which have been multi-transferred from the photosensitive member can be transferred onto the endless belt without being pressed heavily, whereby favorable transfer of the multi-transferred toner images can be effected on the final copying sheets.

The circumferential length of the endless belt as the intermediate image transfer member is so selected that it may be coincident with, or be somewhat longer than, either the maximum scanning length of an original of the main body of the reproduction apparatus or the circumferential length of the photosensitive member. In the present invention, however, it is possible to arbitrarily select the length of the belt without regard to the scanning length or the circumferential length of the photosensitive member. The reason for this is that the surface of the photosensitive member can be cleaned by means of a cleaning device every time a toner image has been transferred to the endless belt, after which it receives onto its surface a newly formed toner image, thereby being able to form toner images as the extension of the same scanning operation. In more detail, when the length of the surface of the photosensitive member is kept shorter for various reasons such as, for example, economy in construction and operations of the reproduction apparatus, or others, the photosensitive member can be used over and over again for transfer of the toner images formed from the color separation of one and the same image original.

Incidentally, in the color reproduction apparatus of a type, in which an image original is exposed onto the photosensitive member by reciprocating movement of an image placement table and a scanning mirror, the photosensitive member keeps its rotation even at the return motion of these reciprocating means, and the endless belt also continues its travelling during this rotation of the photosensitive member. Accordingly, during idle operation of the reciprocating means in their return motion, the photosensitive member performs its rotation, while causing the toner images transferred onto the belt to be press-contacted to it. This brings about an unfavorable situation, namely that the toner images transferred onto the belt is pressed thereon, and produces poor results when transferring the same to a copying sheet as the final image transfer medium.

In order that the photosensitive member may not continue to press the toner images on the belt during a period when the image original cannot be exposed to the photosensitive member due to return (or reverse) movement of the abovementioned reciprocating means, the endless belt as the intermediate image transfer member according to the present invention, in its further developed form is so constructed that it may be separated from the photosensitive member. Such contact and separation of the belt is controlled by a simple expedient made up of links and plungers in combination.

When the circumferential length of the belt which transfers the toner images is longer than the circumferential length of the photosensitive member so that the two are not coincident with each other, the formation of toner images on the seam of the belt is avoided by forming the photoconductive layer of the photosensitive member in a seamless manner.

Further, when the belt is made to pass by the photosensitive member with a small gap between them, and an electric field is created between the photosensitive member and the image transfer corona to cause the toner images to move through the space gap toward the belt due to the force of attraction of the electric field, separation of the belt after every transfer operation can be dispensed with. However, the resolution of the transferred image may become degraded with such a construction.

According to the preferred embodiment of the present invention, the image transfer corona is disposed as an integral part of a supporting means for the belt. That is to say, when the electric field for the image transfer takes effect on the toner images on the photosensitive member depending on a position of the belt, and the belt rotates with its rotational axis as its center of rotation to be separated from the photosensitive member, the corona discharger also separates from the photosensitive member.

The accompanying drawing, in reference to which the present invention will be described in detail, illustrates a cross-sectional view of a preferred embodiment of the present invention.

On a glass plate 1, there is placed or mounted an image original. This original is scanned by an exposure scanning means constructed with an illuminating means 2 using a lamp and plain mirrors 4, 5 reciprocating in the directions of a double-pointed arrow 3. At the time of the image original scanning, the illuminating means 2 and the mirrors 4, 5 move to their respective positions 4' and 5'. Further, in this case, the mirror 4 moves at a speed twice as fast as that of the mirror 5 so as to maintain constant a light path length between a focal point A where the original has been exposed and an image forming lens 6. In the meantime, the image original is focussed on a point B on the surface of the photosensitive member 8 through a plain mirror 7. In the above-mentioned light path, there is positioned a predetermined one of four color filters 9, 10, 11 and 12 namely blue, green, red and ND filters, respectively, by turret-revolution. As a result, a predetermined, color-separated image of the original is exposed onto the photosensitive member, whereby an electrostatic latent image corresponding to each color filter is formed.

The latent image formation on the photosensitive member 8 is done by the Carlson process. A charging corona discharger prior to the exposure is designated by a reference numeral 13. For developing the color-separated electrostatic latent images formed on the photosensitive member, use is made of four developing devices 15, 16, 17 and 18 for different colors of yellow, magenta, cyan and black, respectively, all of which are fixedly provided.

Each of these developing devices is so constructed that a magnet roller having a fixed magnetic center and a non-magnetic, electrically conductive roller 20 rotating around the magnet roller are rotatably disposed in contiguity to the photosensitive member 8. The developing device feeds the conventional color developing agent consisting of iron powder carrier and insulative toner onto the surface of the photosensitive member. The electrostatic latent image formed on the photosensitive member is developed by applying a developing bias voltage to only one of the developing devices, for example the roller 20 of the developing device corresponding to a specific color-separation filter.

Each of the thus developed color toner images on the photosensitive member is conveyed to the image transfer position C where the endless belt 22 rotating in the arrow direction 21 comes into contact with the photosensitive member 8 only at the time of image transfer. In the meantime, the image transfer corona discharger 27 becomes actuated at the time of the development, and transfers the toner images onto the endless belt 22. The belt 22 is extended over and along rollers 23, 24 and 25, and moves in the clockwise direction.

It should be noted that, while the belt 22 is required to have a length greater than the scanning distance of the image original, the circumferential length of the photosensitive member may be arbitrary. In the above-described construction, since the photosensitive member 8 continues its rotation while it is moving toward the starting position, i.e., while it is in the return motion, after the scanning elements 4 and 5 in the optical system have completed scanning of the image original, it comes into contact with the toner images transferred onto the belt, hence it may possibly idle over the toner images already transferred onto the belt in a condition of its press-contacting or being in touch with the toner images.

The abovementioned condition unavoidably invites pressing of the toner image either in a single color or in a plurality of colors, which have already been overlaid on the belt 22. On account of this, the belt has a construction which makes it possible to move toward the position 22', and the roller 23 rotates toward a position 23' shown by a double-dot-and-dash line. As stated above, since the corona discharger 27 is in a combined structure with the belt, it moves toward this double-dot-and-dash line position 23' along with the belt when it is rotated clockwise.

Removal of the belt 22 from the photosensitive member, while in rotation, can be dispensed with, in case the belt passes by the photosensitive member 8 with a small gap therebetween, although the image resolving power might become degraded to cause a problem in operation of the reproduction apparatus.

The toner image before the transfer position C and the electric charge on the photosensitive member are extinguished by, for example, charging of the corona discharger 28. In this case, there is created electric field, within the extent for the image transfer, having a sufficiently large potential difference to cause the toner to jump from the photosensitive member 8 onto the belt 22.

As soon as the toner images in all colors have been transferred onto the belt 22, a copy sheet is fed from either cassette 30 or 31 by means of a sheet feeding roller **30*a* or 31*a*, and conveyed into a space between the transfer corona discharger 32 and the belt 22. The corona discharger 32 functions to transfer and accumulate, in one step, onto the copy sheet those toner images as mentioned above which have been superposed on the belt 22. Thereafter, the copy sheet holding thereon the toner images is forwarded by a conveying belt 33 to an image fixing device 34 where the toner images are fixed on the copy sheet by, for example, pressure force. After the image fixing, the copy sheet is discharged into a receiving tray 35**.

According to the above-described construction, since the toner images in each and every color are superposed loosely in a sequentially layered form, they can be transferred in a favorable condition onto the copy sheet at the time of the image transfer in one step. In more detail, since the toner images are loosely laminated, an electric field at the time of the image transfer acts onto each and every color toner in layer form, thereby increasing the image transfer efficiency. Accordingly, not only is the quantity of the transfer to the copy sheet toner increased, but also the toner transfer can be done in a short period of time, hence the copy-making speed can also be increased.

The belt rotating mechanism in the afore-described embodiment is such that the belt and the image transfer discharger are integrally supported on a structural side plate, and this side plate is pivotally supported on one shaft as the center of rotation. In this belt rotating mechanism, the structural side plate is constantly energized by a spring, etc. in the direction to be away from the photosensitive member, and only when necessary is the side plate moved toward the photosensitive member by use of an electromagnetic plunger SL to effect transfer of the toner images on the photosensitive member to the belt. Incidentally, the image transfer discharger may be controlled for its operation with a detection signal from a micro-switch, etc. for detecting the moving position of the side plate.

In the afore-described embodiment of the image transfer device according to the present invention, use is made, as the intermediate image transfer member, of an endlessly moving insulated belt having a structure of an electrically conductive base member with an insulative resin layer being provided thereon. For another embodiment, there may be used an insulated belt which takes both positions of contact with, and separation from, the photosensitive member. As for the color developing devices per se, one for black toner may be provided depending on necessity. As regards formation of the color toner image, the invention is equally effective for use with latent images for color reproduction which are formed with digital signals as latent images formed in accordance with an image original. Furthermore, the photosensitive member may be not only of a drum type, but also of a belt type. In case the latent images for color reproduction are formed by a needle electrode system or an ion control system, the above-mentioned photosensitive member may be replaced by an insulated drum which is one embodiment of the latent image holding member. Needless to say, since both the latent image holding member and the intermediate image transfer member may take various shapes, the combination of their shapes may be arbitrarily selected.

Although the specific details of the present invention have been described with reference to a preferred embodiment thereof, it should be noted that various changes and modifications may be made within the spirit and scope of the invention as recited in the appended claims.

What I claim is:

1. A device for transferring toner images onto an image transfer material which comprises:

(a) a latent image holding member;

(b) latent image forming means for forming electrostatic latent images on said latent image holding member;

(c) developing means for toner-developing the electrostatic latent images formed on said latent image holding member;

(d) an intermediate image transfer member, onto which a plurality of toner images developed by said developing means are sequentially transferred in superposed relationship;

(e) image transfer means for transferring the plurality of toner images transferred to said intermediate image transfer member onto an image transfer material in a single transfer step; and (f) means for moving said intermediate image transfer member into contact with said latent image holding member only during image transfer.

2. The image transfer device as set forth in claim 1, wherein a plurality of latent images for a single, color reproduction are formed on said latent image holding member; wherein said plurality of latent images are developed in sequence after every formation thereof by a different one of a plurality of developing means, each containing therein a predetermined different color toner; and wherein the color toner images are transferred onto said intermediate image transfer member every time said latent image holding member is developed with color toner.

3. The image transfer device as set forth in claim 2, wherein said latent image holding member comprises an electrophotosensitive member; wherein the latent images formed by said latent image forming means are color-separated images of an image original formed by color-separation filters; and wherein said developing means comprises a plurality of developing devices, each device containing therein a color toner corresponding to an associated one of the color-separated latent images.

4. The image transfer device as set forth in claim 1, 2 or 3, wherein said intermediate image transfer member is rotationally movable about one axis as the center of rotation with respect to said latent image holding member.

* * * * *